US005352052A

United States Patent [19]

Kaufmann

[11] Patent Number: 5,352,052

[45] Date of Patent: Oct. 4, 1994

[54] DEVICE FOR APPLYING WRITING, DRAWING, PRINTING AND PAINTING FLUIDS ONTO A SURFACE

[75] Inventor: Rainer Kaufmann, Hamburg, Fed. Rep. of Germany

[73] Assignee: Dataprint Datendrucksysteme R. Kaufmann KG, Hamburg, Fed. Rep. of Germany

[21] Appl. No.: 994,899

[22] Filed: Dec. 22, 1992

Related U.S. Application Data

[63] Continuation-in-part of Ser. No. 966,901, Oct. 26, 1992, abandoned, which is a continuation-in-part of Ser. No. 700,575, May 14, 1991, abandoned.

[30] Foreign Application Priority Data

May 15, 1990 [DE] Fed. Rep. of Germany ..... 4015586

[51] Int. Cl.[5] ..... B43K 5/18; B43K 8/08; B43M 11/06

[52] U.S. Cl. ..... 401/199; 401/205; 401/217; 401/151; 401/230

[58] Field of Search ..... 401/198, 199, 223, 224, 401/241, 242, 250, 249, 230, 151, 225, 229, 217, 219, 205

[56] References Cited

U.S. PATENT DOCUMENTS

| | | | |
|---|---|---|---|
| 1,299,836 | 4/1919 | Jolly | 401/232 X |
| 1,343,085 | 6/1920 | Lerch | 401/198 X |
| 2,088,283 | 7/1937 | Armfelt | 401/198 |
| 2,522,553 | 9/1950 | Wittnebert | 401/223 |
| 2,523,411 | 9/1950 | Bauer | 401/230 |
| 2,642,043 | 6/1953 | Miessner | 401/242 X |
| 2,737,329 | 3/1956 | Bolsey | 401/242 X |
| 4,509,876 | 4/1985 | Hori | 401/151 X |
| 4,712,937 | 12/1987 | Schmidt et al. | 401/199 X |

FOREIGN PATENT DOCUMENTS

| | | | |
|---|---|---|---|
| 1193795 | 5/1959 | France | 401/199 |
| 717617 | 10/1966 | Italy | 401/199 |
| 17770 | 7/1970 | Japan | 401/199 |

*Primary Examiner*—Danton D. DeMille
*Attorney, Agent, or Firm*—Robert W. Becker & Associates

[57] ABSTRACT

A device for applying writing, drawing, printing and painting fluids onto a surface is provided. The device comprises a fluid container, a respective applicating tip, an air inlet tube that connects an interior of the fluid container to the surrounding atmosphere, and a capillary fluid reservoir. The capillary fluid reservoir is arranged within a fluid conveying connection between the fluid that is contained in the fluid container and the applicating tip whereby the fluid conveying connection is interrupted when the applicating tip is pointed in a downward direction.

4 Claims, 7 Drawing Sheets

SECTION C-D

DEVICE FOR APPLYING WRITING, DRAWING, PRINTING AND PAINTING FLUIDS ONTO A SURFACE

This application is a continuation-in-part of application Ser. No. 966,901, filed Oct. 26, 1992, now abandoned, which is a continuation-in-part of application Ser. No. 700,575, filed May 14, 1991, now abandoned.

BACKGROUND OF THE INVENTION

The present invention relates to a device for applying writing, drawing, printing, or painting fluids etc. to a surface, whereby the device comprises a fluid container, a respective writing, drawing, printing or painting applicating tip etc., an air inlet tube that connects the interior of the fluid container to the surrounding atmosphere, and a capillary fluid reservoir.

Devices of the aforementioned kind are known in many variations and are employed in many private and commercial sectors, for example, as markers or painting utensils etc.

All of these devices have one common disadvantage: the fluid container can only hold a limited supply of writing fluid. When attempting to increase the capacity of the fluid container for the respective writing fluid in the aforementioned known devices by increasing the size of the fluid container itself, this would result in the leakage of the writing fluid from the container via the applicating tip because of the weight of the fluid itself, when the device is a vertical position usually necessary for writing. This approach is therefore not applicable.

When attempting to prevent leakage of fluid from larger liquid containers by directly filling the liquid container, completely or partially, with a capillary reservoir means it is possible to control leakage for such larger fluid containers, but this embodiment has the unacceptable disadvantage that during the writing process a great portion of the fluid will remain in the capillary reservoir means thereby being inaccessible for the writing, drawing, painting or printing process. The result would again be a device with an accessible fluid volume that is to small.

It is therefore an object of the present invention to provide a device of the aforementioned kind with which, in principal, no limitation of the filling amount of the fluid is known, which is easy to operate and to handle, which may be used for various applications of fluids, and which is also easy to manufacture.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
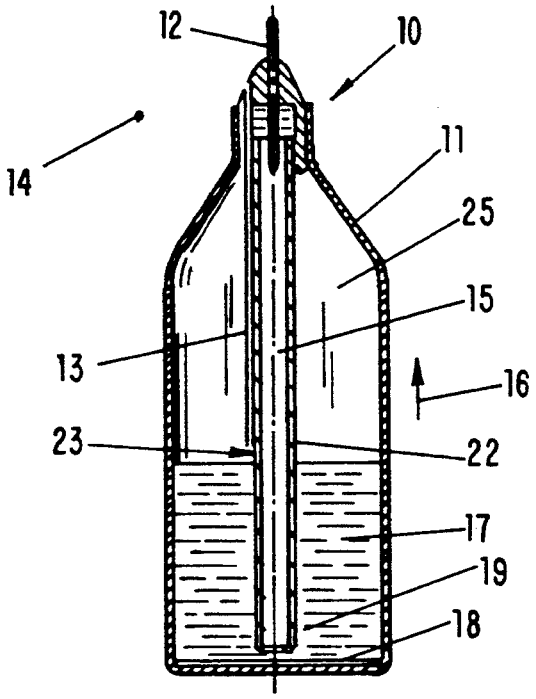
FIG. 1 is a cross-sectional side view of a device of the present invention with a bottle-shaped fluid container in its filling position.

The device of the present invention is primarily characterized by the capillary fluid reservoir being arranged within a fluid conveying connection between the fluid that is contained in the fluid container and the applicating tip, whereby the fluid conveying connection is interrupted when the applicating tip is pointed in a downward direction.

The advantage of the device of the present invention is that, in principal, the conveying of the fluid to the applicating tip is independent of the volume of the fluid container and thus from the momentary fluid volume. When the device is used for writing, drawing, printing or painting, i.e., when the applicating tip is directed downward toward the surface, the filling process of the capillary fluid reservoir is interrupted. The fluid reservoir is only filled when the device is in a horizontal position or is essentially positioned such that the applicating tip is pointing upward, i.e., in a vertical respectively in an upwardly directed position, which may be simply achieved with a short movement of the device into one of the described positions.

The capillary fluid reservoir is dimensioned such that, depending on the embodiment of the device, writing, painting, printing, or drawing procedures may be carried out uninterrupted by supplying a sufficient amount of fluid until the respective procedure is terminated by the user of the device.

Preferably, the capillary fluid reservoir serves as the fluid conveying connection. It is advantageous that the applicating tip and the capillary fluid reservoir are embodied as an integral part thus forming an inexpensive unit which may be produced in a simple manner.

According to a preferred embodiment of the present invention a flow reduction means is provided between the capillary fluid reservoir and the applicating tip. The flow reduction means is provided in order to adjust a predetermined fluid flow per time unit in the manner of a reducing valve which is of special importance when, after the filling process of the capillary reservoir, the fluid contained therein is at a maximum filling level.

Advantageously, the capillary fluid reservoir is enclosed by a tube, which, on the one hand, provides mechanical stability to the fluid reservoir and, on the other hand, prevents an interaction of the fluid inside the capillary fluid reservoir with the air-filled interior of the fluid container.

To assure that during the filling process essentially the entire fluid volume inside the fluid container is introduced into the capillary fluid reservoir, the fluid conveying connection extends preferably into the vicinity of the bottom of the fluid container, optionally via a capillary connection to the outer wall of the device.

In principle, the device is not limited to a fixed outer or inner geometry, i.e., it may be embodied in any desired shape, for example, in the form of a bottle, a ballpoint pen, a fountain pen etc. Also, the cross sectional shape of the device may be chosen as desired. Advantageously, the capillary fluid reservoir has a ring-shaped or a tube-shaped cross section whereby the boundaries of the fluid reservoir are formed by a tube. This embodiment is easy to manufacture and may be provided in small spaces. The aforementioned tube may enclose the fluid reservoir or may be disposed inwardly from the fluid reservoir whereby especially an embodiment is preferable in which the capillary fluid reservoir having a ring-shaped cross section is in direct contact with the fluid container and its inner wall is limited by the tube.

According to a further advantageous embodiment of the inventive device the fluid container is provided in the form of a volume-adjustable fillable container. This is achieved in the form of a conventional fountain pen with a suction plunger. The filling of the device may also be achieved by providing a simple filling opening into which the fluid is introduced either by conventional cartridges or by refilling from an external fluid reservoir in a known manner.

For certain embodiments of the device it may be advantageous that the end of the capillary fluid reservoir that is facing the bottom of the fluid container is provided with a valve means that is in an open position when the device is in an essentially vertical position with the applicating tip pointing in an upward direction. This embodiment is especially advantageous when the fluid container, in a further advantageous embodiment of the device, is provided in the form of a collapsible hose. Without the provision of such a valve means for a fluid container in the form of a collapsible hose, in which naturally the volume of air within the fluid container is limited to a minimum, fluid would be constantly flowing into the capillary fluid reservoir, even when the device is in its writing position. This is safely prevented by the valve means.

It may also be advantageous that the fluid is not directly received in the fluid container which is provided in the form of a collapsible hose, but to introduce the fluid into a collapsible hose which is disposed in the interior of the fluid container. Thereby a device is provided which maintains its outer unchangeable shape. This is advantageous for the safe handling of the device, whereby, due to the collapsible hose in the interior, the advantages of such a hose are still fully provided.

Finally, it is also advantageous that the air inlet tube is equipped with a space that is filled with a capillary means. The capillary means receives fluid that is introduced into the air inlet tube, for example, due to the expansion of the air volume inside the device caused by warming, by shaking or dropping the device, without a droplet leaving the air inlet opening that is connected to the surrounding atmosphere.

DESCRIPTION OF PREFERRED EMBODIMENTS

The present invention will now be described in detail with the aid of several specific embodiments utilizing FIGS. 1 through 7.

The device 10 (see FIG. 1) comprises essentially a fluid container 11 which, in the embodiment represented in FIG. 1, is bottle-shaped. From the bottle neck an application or writing tip 12 extends which is attached to the bottle neck in any suitable fashion. The end of the writing tip 12 that is facing the bottle interior is connected to a capillary fluid reservoir 15 such that a fluid conveying connection 16, as represented schematically by the arrow in FIG. 1, from the interior 25 of the fluid container 11 to the tip 12 for conveying fluid 17 contained in the capillary fluid reservoir 15 is provided. The capillary fluid reservoir 15 extends in essentially linear form from the bottom 18 to the writing tip 12.

An air inlet tube 13 connects the atmosphere 14 to the interior 25 of the fluid container 11. The air inlet tube 18 serves to displace the fluid 17 inside the fluid container 11, which is released during the application or writing procedure, with air.

The capillary fluid reservoir 15 is enclosed by a tube 22 which, on the one hand, provides a mechanical stabilizing function for the capillary fluid reservoir 15 and, on the other hand, prevents the interaction between the air in the interior 25 and the fluid 17 contained in the capillary fluid reservoir 15 as well as the introduction of fluid 17 into the capillary fluid reservoir 15 when the tip 12 is in a downward position.

The end 19 of the capillary fluid reservoir 15 that is facing the bottom 18 of the fluid container 11 is open for the introduction of fluid 17 that is contained in the fluid container 11.

Figure 2:
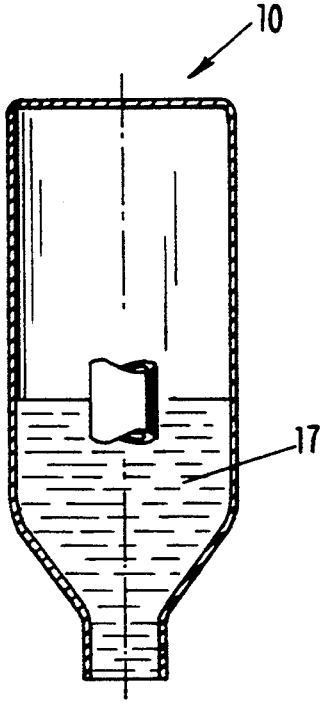
FIG. 2 shows the device of FIG. 1 in its writing position, whereby constructive details have been omitted in order to facilitate the drawing.

FIG. 1 shows the position of the device 10 in which the tip 12, in an essentially vertical position of the device 10 respectively the fluid container 11, is pointing in an upward direction and the capillary fluid reservoir 15 is filled with fluid 17 that is contained in the fluid container 11. In this position the capillary fluid reservoir 15 will be filled to a maximum level with liquid 17. The position represented in FIG. 1 may, for example, be achieved when the device is placed onto a surface whereby, in this inactive position, the capillary fluid reservoir 15 will always be filled. FIG. 2 is a schematic representation of the active or writing position whereby it can be seen that in this position the fluid 17 may not enter the capillary fluid reservoir 15. In this position the device 10 may be used until the entire fluid 17 that is contained in the capillary fluid reservoir 15 is used up, which, when the volume of the capillary fluid reservoir 15 is suitably selected, ensures an uninterrupted writing procedure It is understood, that in this connection for reasons of simplifying matters only a writing procedure is addressed. The writing procedure to be carried out with the device 10 encompasses also drawing, printing or painting procedures etc., whereby for these different purposes the tip 12 must be chosen accordingly.

The relatively simple embodiment of the device 10 provides a high efficiency of the device 10 and, on the other hand, assures that the device 10 may be manufactured in a simple and inexpensive manner so that the device 10 may be supplied as a mass-produced article to a wide circle of buyers and users.

Figure 1A:
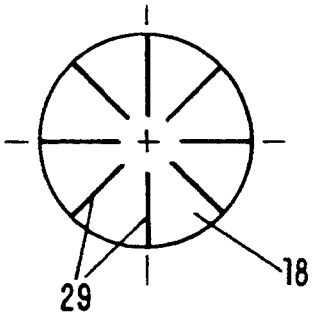
FIG. 1*a* is a plan view of the inner surface of the bottom of a bottle-shaped fluid container according to FIG. 1.
Figure 3:
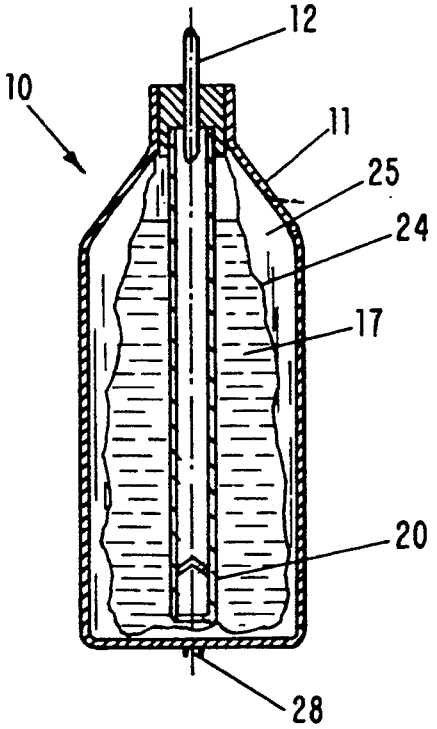
FIG. 3 is a device according to the representation of FIG. 1, being equipped with a collapsible hose disposed inside the fluid container which receives the fluid and having a valve means at the capillary fluid reservoir.
Figure 3A:
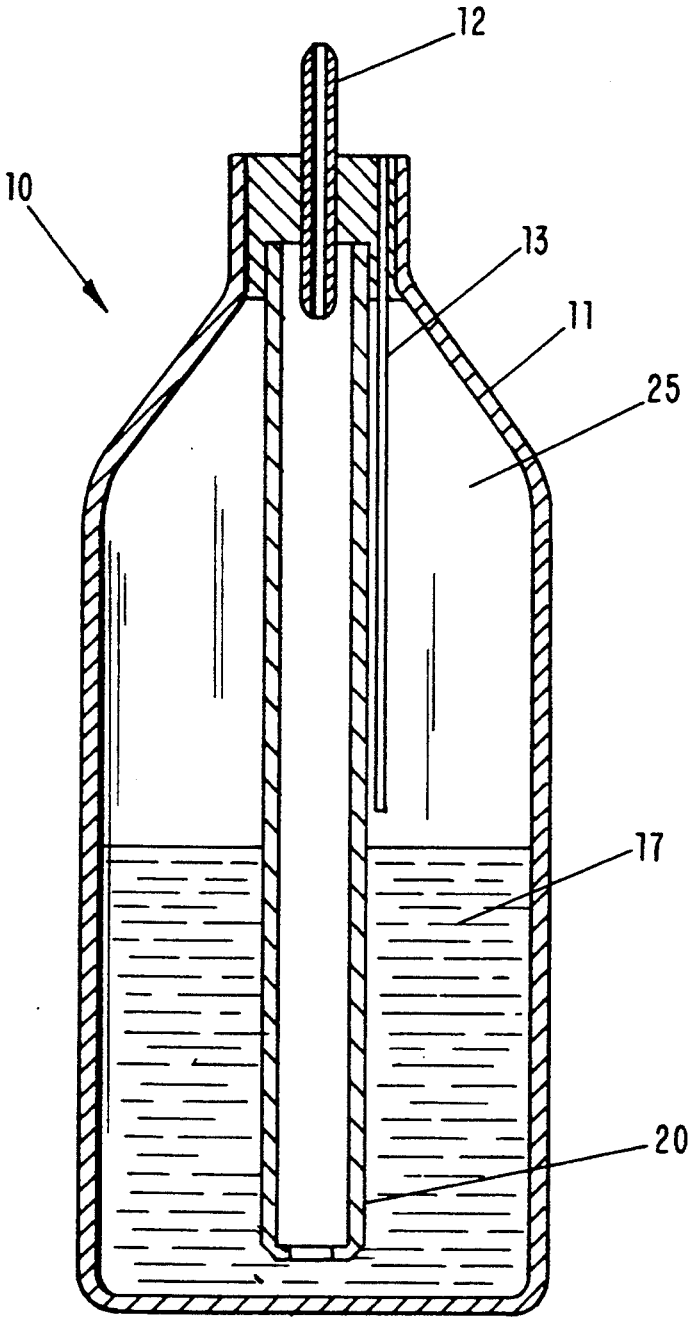
FIG. 3*a* is a device according to the representation of FIG. 1, having a valve means at the end of the capillary fluid reservoir.
Figure 8:
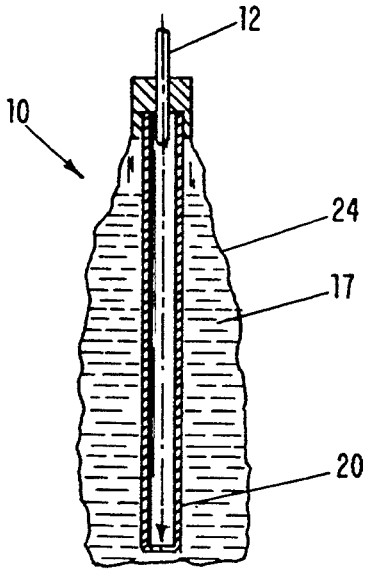
FIG. 8 shows a device having a collapsible hose as the fluid container.

In the embodiment represented in FIG. 3 the fluid 17 is received in a collapsible hose 24 that is disposed in the interior 25 of the fluid container 11 so that thereby the entire interior 25 is filled with liquid 17. At the end 19 of the capillary fluid reservoir 15 a valve means 20 is disposed which assures that the fluid 17 may only enter the capillary fluid reservoir 15 from the fluid container 11 respectively the interior of the hose 24 when the filling position according to FIGS. 1 or 3 is assumed, but not when the writing position of the device 10 according to FIG. 2 is assumed. The valve means 20 may be actuated either by gravity or by an actuating member 28 which extends from the fluid container 11 and which, against the force of a return spring that is located inside the valve means, is actuatable either manually or by placing it on a surface. It is noted that it is also possible to provide the fluid container 11 itself in the form of a collapsible hose 24 (FIG. 8). In FIG. 1*a* the inner bottom of the fluid container is shown. The capillaries 29 represented therein allow the filling of the capillary fluid reservoir 15 when the fluid container 11 is in a horizontal position and when the filling level of fluid 17 is low.

Figure 4:
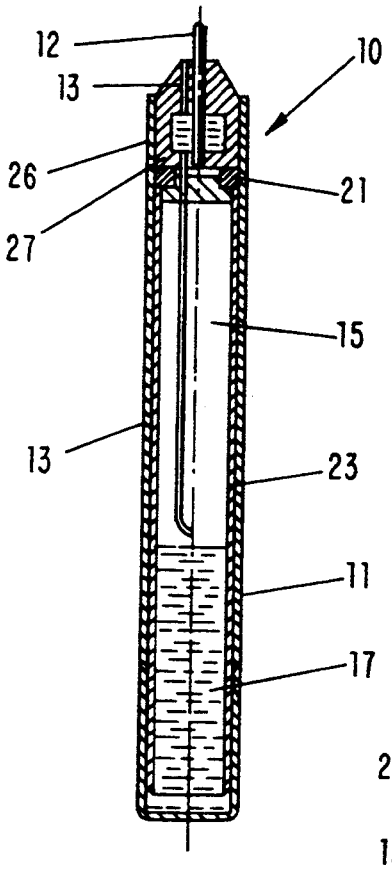
FIG. 4 shows a different embodiment of the device with respect to the embodiments of FIG. 1 to 3 having a ring-shaped capillary fluid reservoir.

The embodiment according to FIG. 4 shows a manual writing device that is commonly used for writing or drawing. Accordingly, the diameter of the fluid container 11 is adjusted to dimensions that are commonly used for handwriting or drawing devices. The device represented in FIG. 4 differs from embodiments of the device 10 according to FIGS. 1 through 3 in that it is provided with a capillary fluid reservoir 15 that is not embodied with a full cross-section but is provided in the form of a ring. A tube with walls 23 is inserted into the fluid container 11. The distance between the tube respectively the tube walls 23 and the inner surface of the fluid container 11 is selected such that in the space between the tube and the fluid container 11 the capillary fluid reservoir 15 is formed. Between the capillary fluid reservoir 15 and the tip 12 a flow reduction means 21 is arranged that, in the fashion of a reducing valve, provides a predetermined amount of fluid 17 per time unit independent of the filling level of the capillary fluid reservoir 15. Thereby outer influences such as warming of the surrounding atmosphere, changes in pressure and so on are eliminated. Thus a continuous flow of fluid 17 is ensured and continuously provided.

Figure 5:
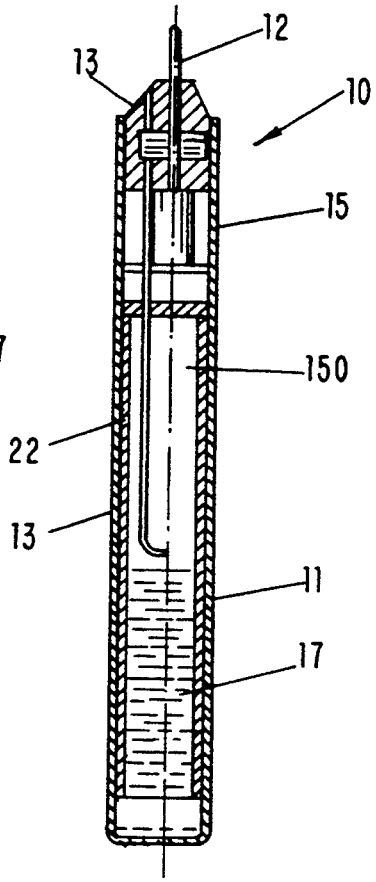
FIG. 5 is a device according the representation of FIG. 4, having a ring-shaped capillary fluid reservoir which contacts, on the one hand, the inner wall of the fluid container and, on the other hand, is limited on its inner side by a tube.
Figure 5A:
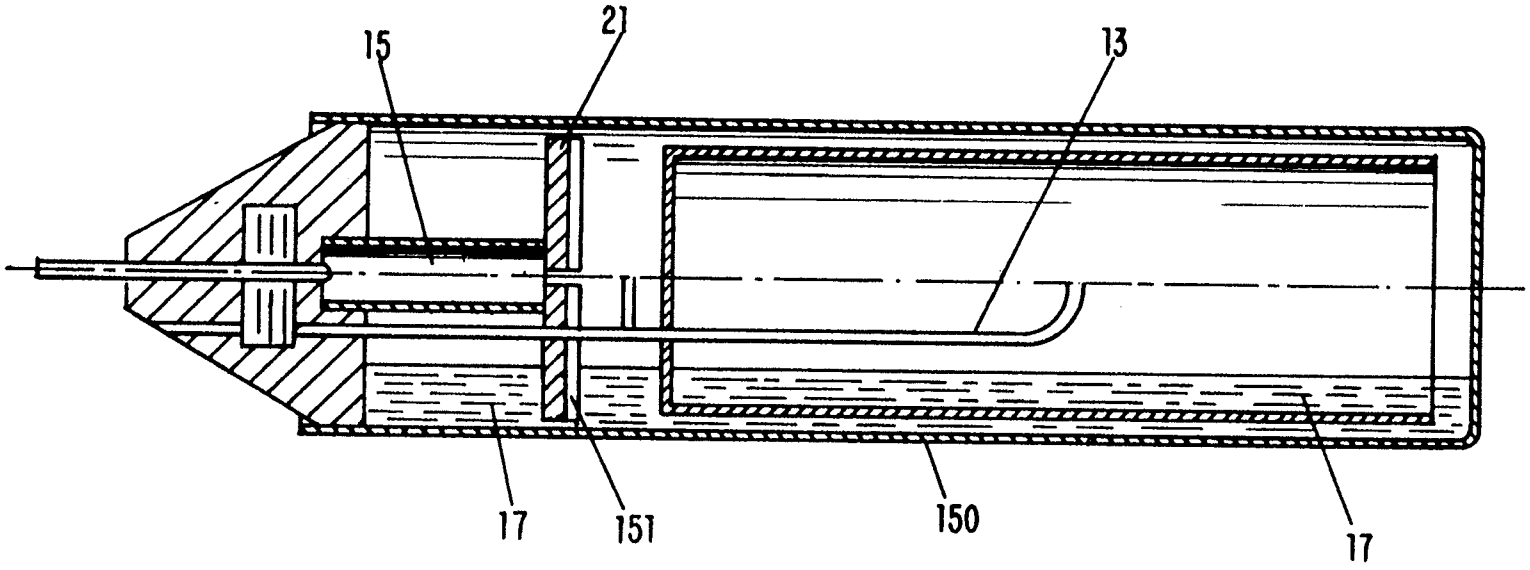
FIG. 5*a* shows the device of FIG. 5 in a horizontal filling position.
Figure 5B:
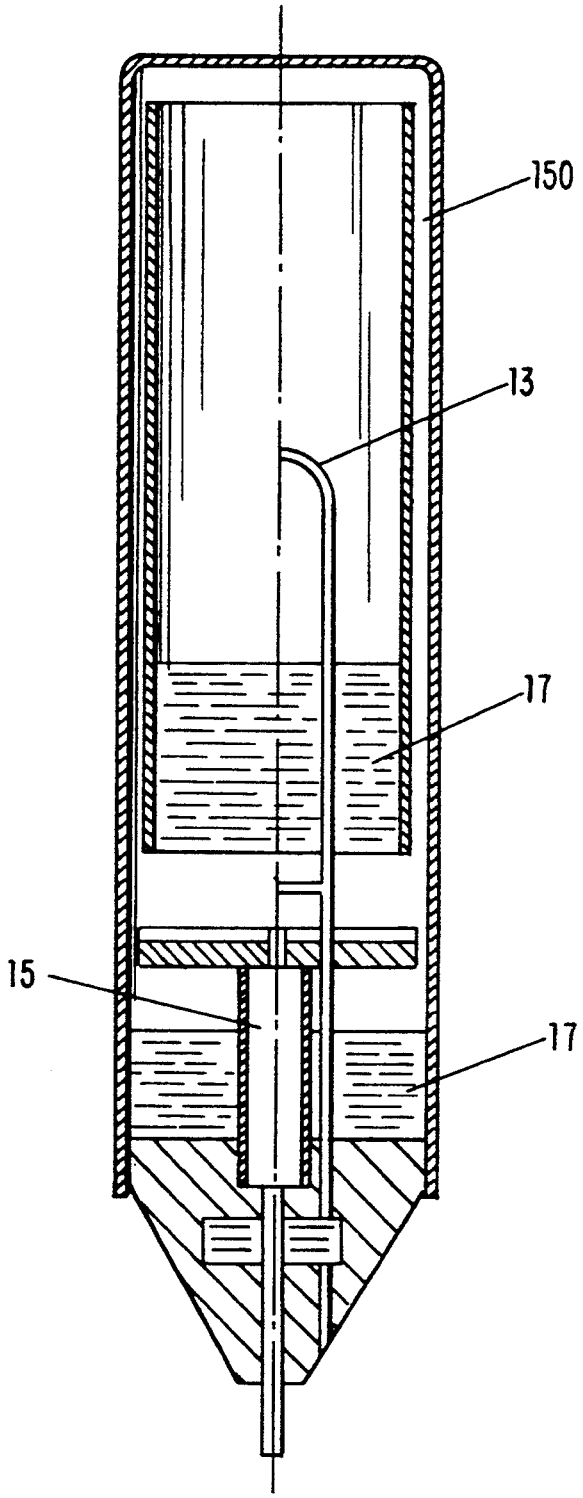
FIG. 5*b* shows the device of FIG. 5 in a vertical operating position.

The embodiment according to FIG. 5 differs from FIG. 4 in that essentially two inventive devices are arranged in series. When the device according to FIG. 5 rests in a horizontal position (FIG. 5*a*), writing fluid flows through a first annular space 150 (a first capillary reservoir) into the space before the flow reduction means 21 so that this space functions as a pre-reservoir. A second capillary means 151 serves to fill the actual capillary reservoir 15 with fluid 17. In FIG. 5*b* the inventive device is shown in its operating position, whereby the flow of fluid 17 into the reservoir 15 is interrupted.

Figure 6:
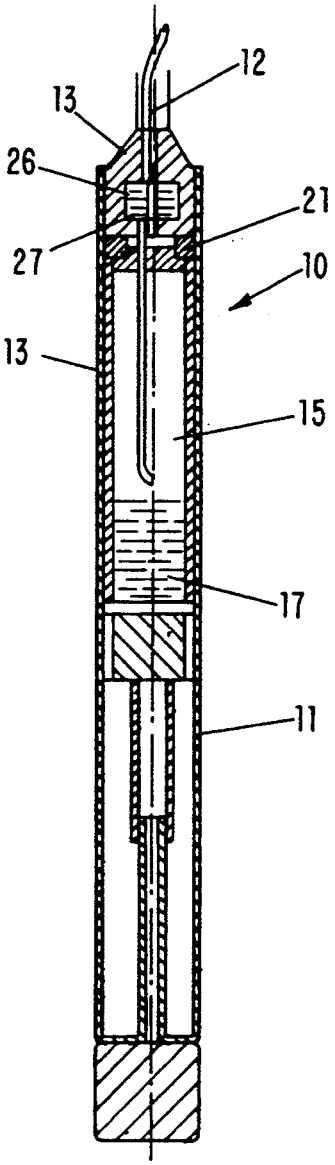
FIG. 6 shows a further embodiment in the form of a fountain pen having a variable fluid container volume, respectively a fluid container of an adjustable volume which may be filled with fluid by a manually actuatable plunger.

The embodiment of the inventive device 10 as represented in FIG. 6 is fundamentally identical to the embodiments of the FIGS. 4 and 5. The device is in the form of a common fountain pen whereby the fluid container 11 is provided in the form of a volume-adjustable container which may be filled by a manually actuatable filling plunger. The tip 12 of the device 10 according to FIG. 6 is not provided in the form of a tubular tip but as a pen point which is known from commonly used fountain pens.

All three embodiments shown in the FIGS. 4 to 6 have an air inlet tube 13 that is provided with a space 27 which is filled with a capillary means 26. The space 27 respectively the capillary means 26 therein serve to intercept fluid 17 which may enter, due to shaking or fast movements or warming of the device 10, the end of the air inlet tube 13 that extends into the interior 25. The space 27, respectively the capillary means 26 disposed therein, thus prevents the fluid 17 from being released from the opening of the air inlet tube 13 that is open to the atmosphere 14.

Figure 7:
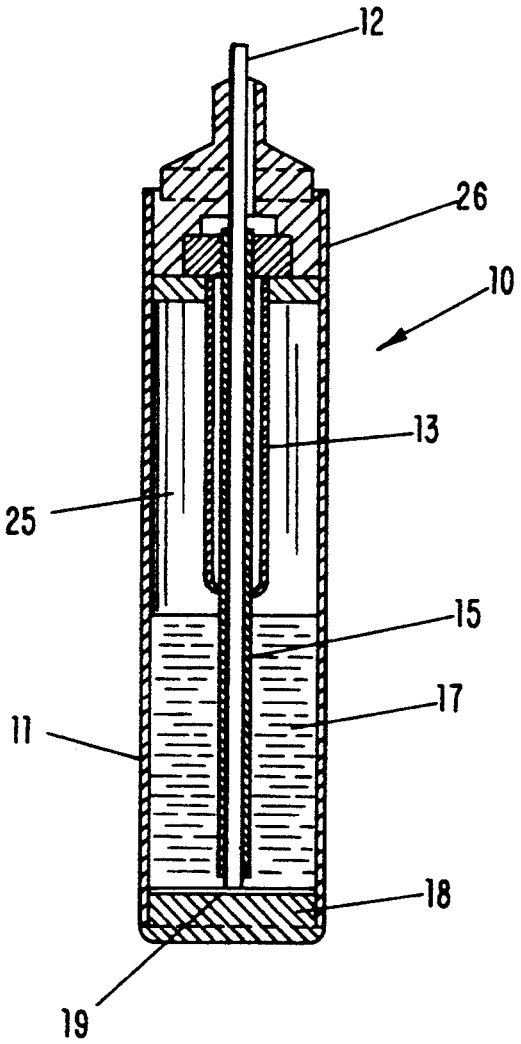
FIG. 7 is a device having the capillary fluid reservoir and the applicating tip formed as an integral part.

The embodiment according to FIG. 7 is characterized by having the applicating tip 12 and the fluid reservoir 15 formed as one integral part. The other components and functions thereof are essentially identical to the respective parts and their functions in the aforementioned embodiments.

Figure 9:
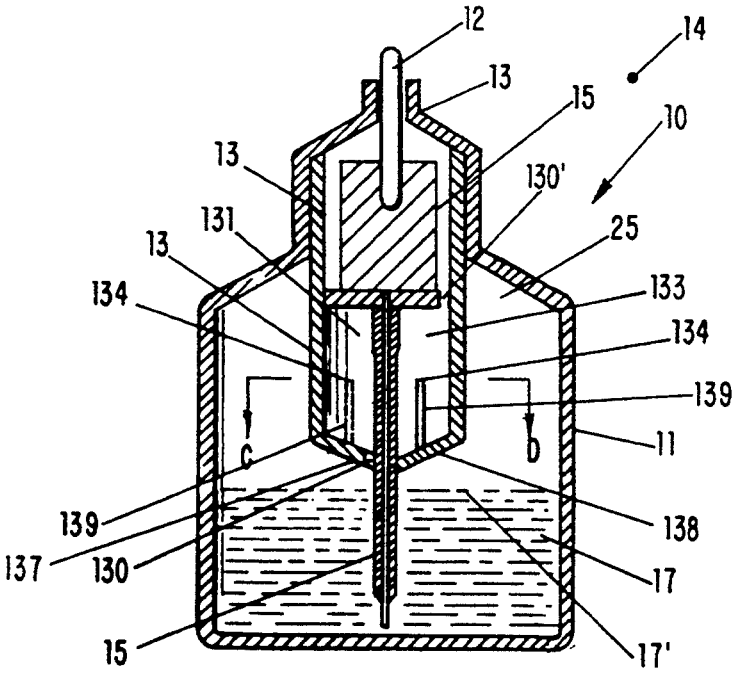
FIG. 9 shows a further embodiment in which the air inlet tube comprises three interconnected chambers with capillary tubes.
Figure 9A:
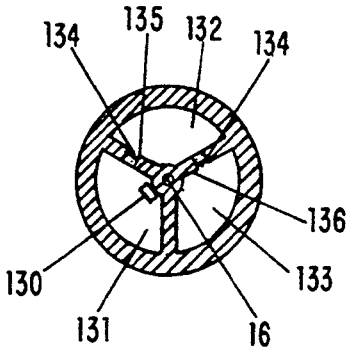
FIG. 9*a* shows a cross-sectional view along the line C-D of FIG. 9.

A special embodiment of the present invention is shown in FIGS. 9 and 9*a*. The air inlet tube 13, with its air opening 130 facing the interior 25 of the fluid container 11 and its opening 130' facing the atmosphere 14, is provided with a plurality of chambers, in the present case three chambers 131, 132, 133 that are connected to one another by a connection 134 that is embodied as bores through the chamber walls 135, 136. Capillary tubes 139 extend from the bottom portions 137, 138 of the chambers and open into the bores 134. The chambers 131, 132, 133 that are sequentially connected thus form a labyrinth through which the fluid to be dispensed, even after extreme agitation or shaking, cannot pass and thus cannot reach the atmosphere 14.

However, fluid that has entered the chambers 131, 132, 133 due to agitation may drain from the chambers 131–133 when a vacuum exists in the interior 25. A compensation of the vacuum takes place through drainage of the fluid from the chambers 131–133 until the chambers are completely empty.

The emptying is affected such that the fluid rises within the capillary tubes 139 and closes the connection 134 (bores) between the chambers 131, 132, 133 as long as fluid is still present in the chambers 131–133. Subsequently, air can pass freely through the chambers 131–133.

All embodiments according to the present invention are especially protected against leakage of fluid when the container is filled only to about one half its maximum volume because then the resulting fluid level 17' will not reach the opening of the air inlet tube in the interior of the container.

However, the container may also be filled past the 50% mark (fluid level 17'), when the fluid volume that can be received by the capillary means, i.e., the chamber arrangement 131–139 of FIGS. 9 and 9*a*, is sufficiently dimensioned relative to the volume of the container.

The present invention is, of course, in no way restricted to the specific disclosure of the specification, examples and drawings, but also encompasses any modifications within the scope of the appended claims.

What I claim is:

1. A device for applying writing, drawing, printing and painting fluids onto a surface, said device comprising:

a fluid container, a respective applicating tip, an air inlet tube that connects an interior of said fluid container to the surrounding atmosphere, and a capillary fluid reservoir, whereby said capillary fluid reservoir is arranged between fluid, that is contained in said fluid container, and said applicating tip, with a fluid flow being interrupted when said applicating tip is pointed in a downward direction;

said capillary fluid reservoir having a tube delimiting the same within said fluid container and extending into the vicinity of a bottom of said fluid container; and said air inlet tube terminates essentially at the volumetric center of said fluid container.

2. A device according to claim 1, wherein said capillary fluid reservoir has a ring-shaped cross section, with said tube forming a radially inwardly located boundary of said capillary fluid reservoir.

3. A device according to claim 1, wherein an end of said capillary fluid reservoir, said end facing a bottom of said fluid container, is provided with a valve means that is in an open position, allowing flow of the fluid into said capillary reservoir, when said device is in an essentially vertical position with said applicating tip pointing in an upward direction.

4. A device according to claim 1, wherein said air inlet tube is provided with a space that contains a capillary means.

* * * * *